US005131477A

United States Patent [19]

Stagg et al.

[11] Patent Number: 5,131,477

[45] Date of Patent: Jul. 21, 1992

[54] METHOD AND APPARATUS FOR PREVENTING DRILLING OF A NEW WELL INTO AN EXISTING WELL

[75] Inventors: Theodore O. Stagg; Edward R. Clinton; Scott D. Selfridge, all of Anchorage, Ak.

[73] Assignee: BP Exploration (Alaska) Inc., Parens, Ak.

[21] Appl. No.: 642,189

[22] Filed: Jan. 16, 1991

Related U.S. Application Data

[63] Continuation-in-part of Ser. No. 516,252, May 1, 1990, abandoned.

[51] Int. Cl.[5] ..... E21B 47/12

[52] U.S. Cl. ..... 175/40; 73/151; 166/66; 181/101

[58] Field of Search ..... 166/249, 250, 75.1, 166/65.1, 177, 66; 175/40, 45, 56; 73/151, 592, DIG. 1; 181/101, 122; 367/82, 86, 99, 909

[56] References Cited

U.S. PATENT DOCUMENTS

| | | | |
|---|---|---|---|
| 2,149,427 | 3/1939 | Faust | 181/122 |
| 3,282,355 | 11/1966 | Henderson . | |
| 3,285,350 | 11/1966 | Henderson . | |
| 3,722,605 | 3/1973 | Isham . | |
| 3,817,345 | 6/1974 | Bailey . | |
| 3,853,185 | 12/1974 | Dahl et al. . | |
| 3,876,016 | 4/1975 | Stinson . | |
| 4,001,773 | 1/1977 | Lamel et al. . | |
| 4,003,017 | 1/1977 | Bailey . | |
| 4,016,942 | 4/1977 | Wallis, Jr. et al. . | |
| 4,144,949 | 3/1979 | Silverman . | |
| 4,372,398 | 2/1983 | Kuckes | 175/45 |
| 4,391,336 | 7/1983 | Coon . | |
| 4,458,767 | 7/1984 | Hoehn, Jr. . | |
| 4,523,651 | 6/1985 | Coon et al. . | |
| 4,593,770 | 6/1986 | Hoehn, Jr. . | |
| 4,700,142 | 10/1987 | Kuckes . | |
| 4,715,451 | 12/1987 | Bseisu et al. | 175/40 |
| 4,775,009 | 10/1988 | Wittrisch et al. | 166/66 |
| 4,992,997 | 2/1991 | Bseisu | 367/82 |

*Primary Examiner*—David J. Bagnell

*Attorney, Agent, or Firm*—Renner, Otto, Boisselle & Sklar

[57] ABSTRACT

Apparatus and method for noninvasive surface or remote monitoring of activity downhole in a cased bore hole wherein vibrations transmitted through the casing are detected by a vibration transducer coupled to the casing to obtain information about the activity occurring downhole in the cased bore hole. In one embodiment, an acoustic wave or vibration detector is coupled to the wellhead of an existing well or wells. The detector detects the acoustic waves or vibrations transmitted through the existing well that are caused by the drilling of the new well in close proximity to the existing well casing. When the monitored vibrations meet a predeterminedd criteria indicating a closely approaching drill bit or the drill bit striking the casing of an existing well, an alarm signal is produced to warn of the close approach or impact so that appropriate responsive action may be taken.

27 Claims, 3 Drawing Sheets

METHOD AND APPARATUS FOR PREVENTING DRILLING OF A NEW WELL INTO AN EXISTING WELL

RELATED APPLICATION DATA

This application is a continuation-in-part of copending application Ser. No. 07/516,252, filed May 1, 1990 and now abandoned, and which is hereby incorporated herein by reference.

BACKGROUND OF THE INVENTION

Various devices heretofore have been used to monitor or detect activity downhole in a well. Many if not all of these devices require the use of a sensor, or logging tool, that is lowered into the well. Depending on the application, this may, for example, add to the cost of drilling the well or may interfere with normal production of the well being monitored. Consequently, it would be desirable to provide for monitoring of activity downhole in a well without requiring intrusion into the well, i.e., the lowering of a measuring device into the well being drilled or the well being monitored. Moreover, in the case of a producing well, it would be advantageous to be able to monitor downhole activity without having to cease well production.

One specific area of interest is the avoidance of well intersections during drilling of new wells in the vicinity of existing and especially producing wells.

As an oil and gas field matures, the density of drilled wells increases as new wells are drilled to fully develop the field. The density of drilled wells may also be high because of the location of the drill site or permitting. Offshore production facilities are by design very high well density areas, as are some environmentally sensitive areas because of the restricted areas allocated for the drill site. Directional wells are often used to maximize the production of the reservoir formation. To optimize production, directional wells are often drilled such that their paths cross or pass in close proximity to one or more existing wells at one or more points along their lengths.

The close intersections that result from drilling in close proximity to existing producing well pose a problem. If the new well is drilled into an existing producing well, high pressure hydrocarbons from the producing well may follow the drill path of the new well or the casing of the producing well to the surface and result in a "blow-out". Undesirable pressurization of upper formations has also occurred.

Various procedures have been devised to eliminate the possibility of blow-outs or other undesirable consequences of an intersection. A common procedure is to temporarily plug the existing producing well or wells within close proximity of the new well being drilled at least until the new well has been drilled past the point of possible intersection. The temporary plugging operation, however, is expensive and production is deferred during the "shut-in" period. At times, the temporary plugging operation, or "safe-out", may be avoided by designing and drilling the well in a more expensive manner by steering a course far enough away from the existing wells. This latter approach, however, is undesirable because of high cost and in many instances it is difficult if not impossible to implement due to close spacing of wells at the surface, such as exist on offshore platforms and drill pads.

The above problem was addressed by Hoehn, Jr. in U.S. Pat. No. 4,593,770. This patent describes a method for preventing the drilling of a new well into a production well be using a logging sonde to inject alternating current into the well casing of the producing well or wells at desired subsurface depth points. The resulting magnetic fields created around the well casings of the producing wells are detected by a magnetometer in a new well being drilled to prevent drilling into one of the production wells.

SUMMARY OF THE INVENTION

The present invention provides a method and apparatus for noninvasive surface or remote monitoring of activity such as mechanical operations downhole in a cased borehole. For example, the invention may be employed to monitor performance of a mud motor or drill bit by detecting vibrations traveling from the mud motor or drill bit to the surface via the well casing or other tubing string in the well and deciphering the vibrations to extract useful information therefrom.

More particularly, the present invention provides a method and apparatus for preventing the drilling of a new well into a preexisting nearby well or wells, which method and apparatus will afford significant economic benefit to the drilling industry. The invention allows continued production of nearby producing wells while protecting against accidental penetration of the producing wells by warning the driller or initiating other corrective action if the drill bit drilling the new well is coming too close to a producing well or has struck a producing well.

According to the invention, a vibration detector is coupled to the wellhead of an existing well or wells. The detector detects the acoustic waves or vibrations transmitted through the existing well that are caused by the drilling of the new well in close proximity to the existing well. When the monitored vibrations meet a predetermined criteria indicating a closely approaching drill bit or the drill bit striking the casing of an existing well, an alarm signal is produced to warn of the close approach or impact so that appropriate responsive action may be taken or automatically initiated.

Accordingly, the invention provides a method and apparatus for preventing the drilling of a new well into a nearby existing well in a subterranean formation, characterized by detecting vibrations in the existing well during drilling of the new well, and monitoring the detected vibrations and issuing an alarm signal when the detected vibrations satisfy a predetermined criteria indicating too close approach of the new well to the existing well.

In a preferred embodiment, a vibration transducer is used to detect vibrations in the existing well. The vibration transducer preferably is an accelerometer coupled to a metal casing of the existing well, and a pair of matched opposed accelerometers may be used to verify proper operation of the accelerometers. At least one selected band of frequencies corresponding to the acoustic signature of a drill bit drilling the new well is monitored, and the alarm signal may be issued when the amplitude of the selected frequency band exceeds a predetermined level. The alarm signal may actuate a signal light or audible signal, and there may be issued a low alarm corresponding to a closely approaching drill bit and a high alarm corresponding to contact or near contact of a drill bit with the casing in the existing well.

The invention comprises the foregoing and other features hereinafter fully described and particularly pointed out in the claims, the following description and annexed drawings setting forth in detail a certain illustrative embodiment of the invention, this being indicative, however, of but one of the various ways in which the principles of invention may be employed.

DETAILED DESCRIPTION

The invention will now be described in detail by way of a preferred embodiment employed to prevent drilling of a new well into a pre-existing nearby well or wells.

Figure 1:
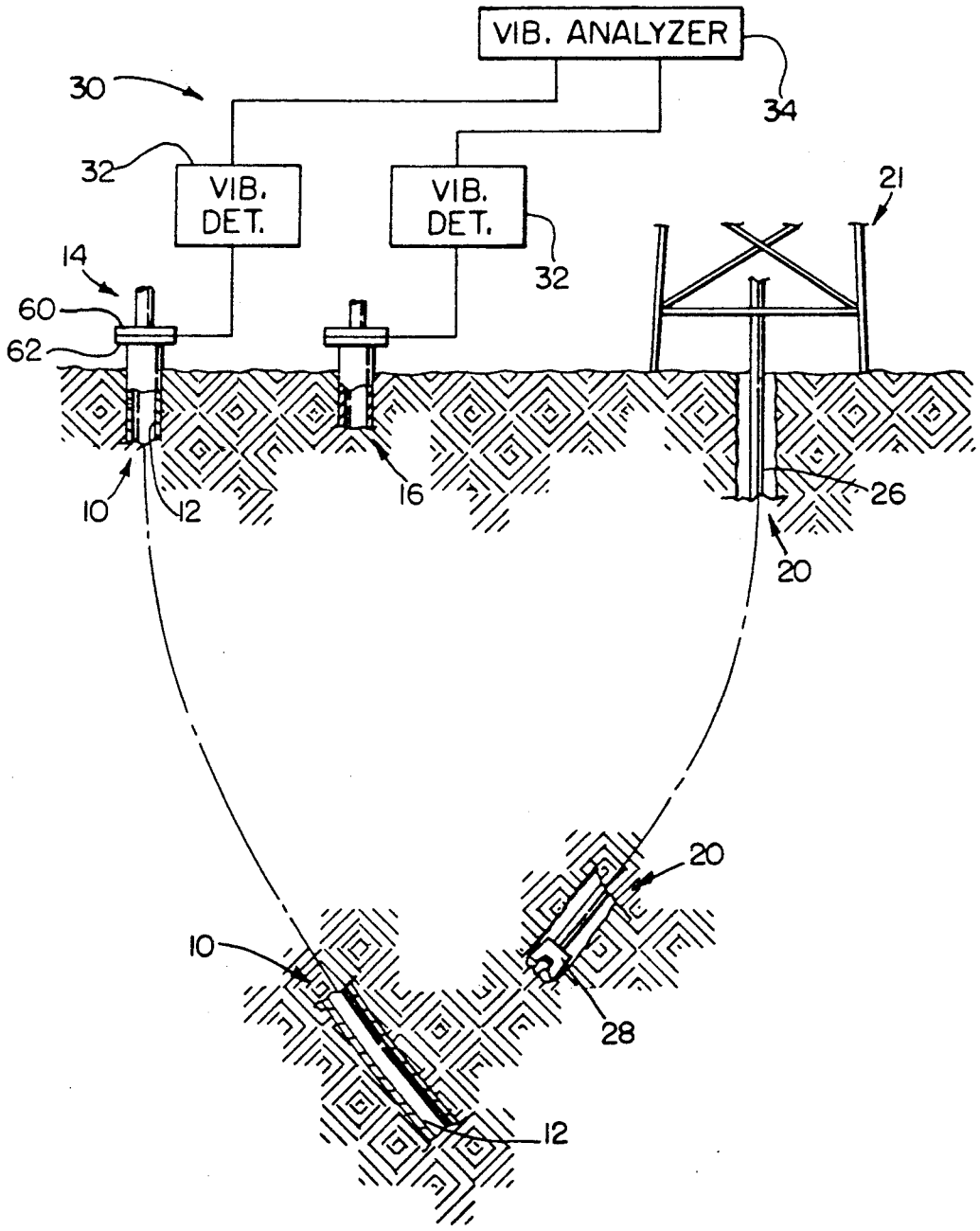
FIG. 1. is a schematic illustration showing drilling of a wellbore in close proximity to existing wellbores to which apparatus according to the invention is connected.

Referring now in detail to the drawings and initially to FIG. 1, a typical wellbore which has been completed for production of hydrocarbons, i.e., oil and/or gas, is illustrated at 10. The wellbore 10 is lined with a steel casing 12 that terminates at its upper end at a wellhead 14. From the wellhead, the casing extends downhole to one or more completed zones. An oil and gas field including wellbore 10 typically would include one or more additional wellbores 16 that have been completed for production to fully develop the field. The depths of the wellbores are dependent on the depths of the subterranean reservoirs containing the hydrocarbons to be produced. In some fields these depths are greater than 10,000 feet.

FIG. 1 also shows a new wellbore 20 being drilled by a conventional drilling rig 21 using drill pipe 26 and a drill bit 28. Directional drilling may be employed to direct the drill bit along a desired path which by design or happenstance may pass near one or more of the existing wellbores 10 and 16. The invention, hereinafter described in detail, functions to protect against drilling of the new wellbore 20 into an existing producing well 10, 16. References herein to a drill bit are intended to generically encompass the various types of drilling implements and associated drilling methods employed to drill wellbores.

Apparatus for practicing the invention is schematically illustrated at 30 in FIG. 1. The apparatus 30 comprises a vibration detector 32 for each well being monitored and a vibration analyzer 34 that monitors the output of the vibration detector or detectors. The vibration detector is coupled to the casing 12 as by mounting to the wellhead 14 to detect acoustic waves or vibrations in the casing. These vibrations include those induced in the casing by the drill bit 28.

Drill bits and drilling methods have been found to produce unique acoustic signatures in the frequency spectrum from 0.1 hz to 10,000 hz. These unique and discernible patterns are transmitted though the formation to the steel casing and further by the steel casing to the wellhead 14 where they may be detected by the vibration detector 32. Other variables remaining constant, the amplitude of monitored signature frequencies is believed to increase in proportion to the decrease in the distance between the active drill bit and the monitored casing. The converse is also believed to be true, i.e., the apparent acoustic energy detected by the vibration detector 32 decreases as the drill bit proceeds past the shortest distance between the drill bit and the monitored casing, although at a rate slower than the drill bit approach.

The increase in amplitude of the drill bit signature frequency or frequencies may be used to establish a criteria on which to base issuance of a signal warning that the drill bit is coming too close to the existing well so that appropriate corrective action may be taken such as steering the drill bit away from the existing well. Moreover, there is basis to believe that forceful metal to metal contact between the drill bit and the metal casing will result in a perceived acoustic (including sub-acoustic) signal at the wellhead in the frequency range of 0.5 hz to 30 hz at a level more than 10 times the level of the signal prior to contact. This manyfold increase in acoustic energy may be used as a criteria for issuing an immediate and positive alarm so that the drilling equipment may be stopped immediately and before perforation of the production tubing or casing by the drill bit. Metal contact between the drill bit and casing may result in generation of an acoustic signal having a frequency corresponding to the natural resonance of the casing string and accordingly the frequency of such signal may vary from well to well.

Figure 2:
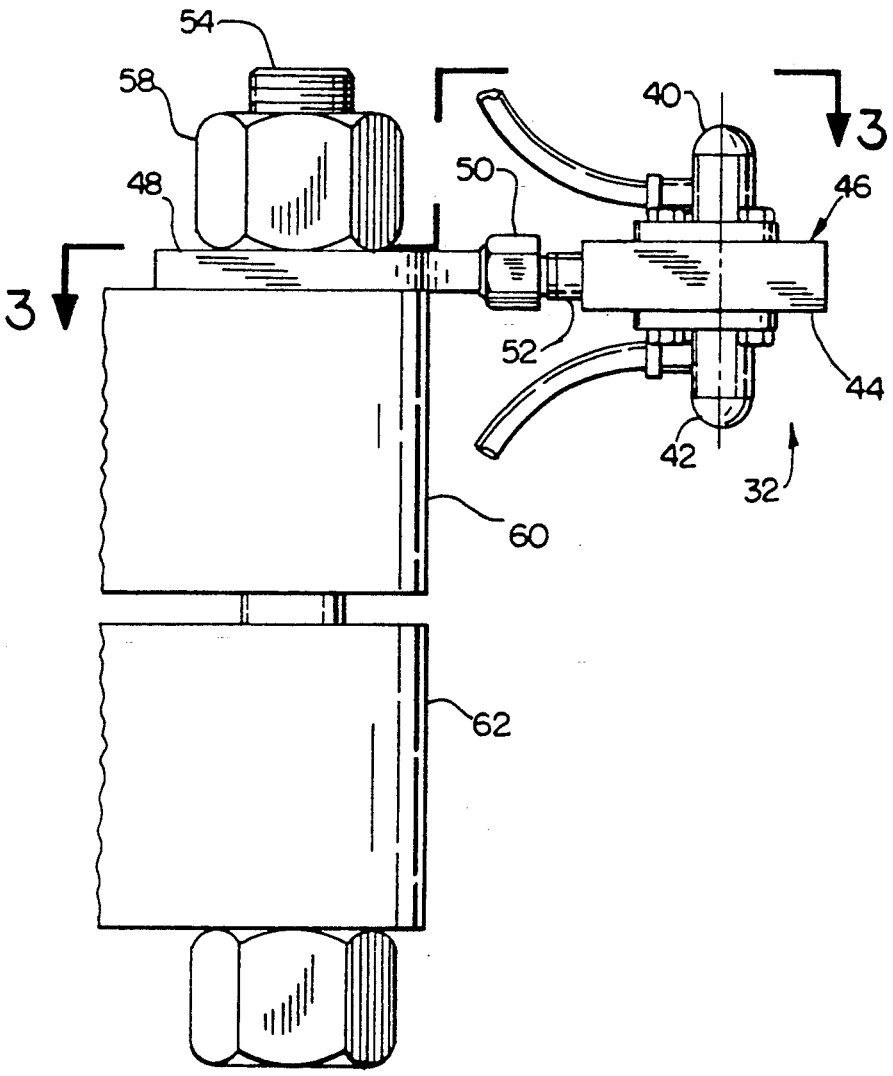
FIG. 2 is an elevation view showing a vibration detector according to the invention mounted to a wellhead.
Figure 3:
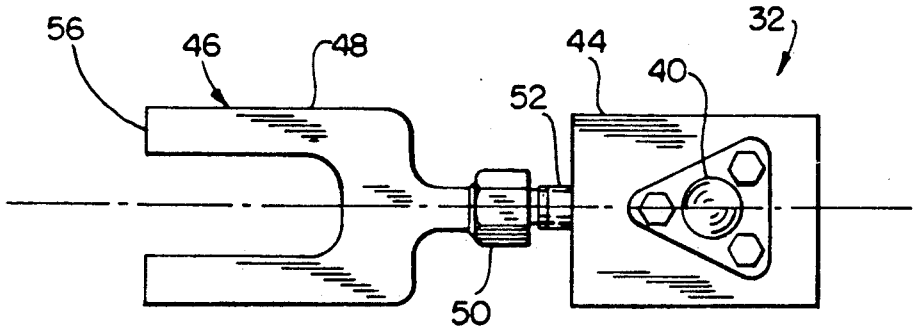
FIG. 3 is a plan view of the vibration detector looking from the line 3—3 of FIG. 2.

Referring now to FIG. 2, the vibration detector 32 in the illustrated preferred embodiment comprises a pair of accelerometers 40 and 42 which function as vibration transducers. The accelerometers are secured by bolts to a support plate 44 of a mounting bracket 46. The mounting bracket 46 also includes a mounting lug 48 which is joined by a union nut 50 to a threaded stub 52 on the support plate 44. The mounting lug 48 is configured for attachment to the wellhead at a flange bolt 54. The mounting lug 48 has a spade end portion 56 (See FIG. 3) that may be fitted on the flange bolt and clamped by flange nut 58 to the bottom wellhead mounting flange 60 on a conventional wellhead system, which bottom flange 60 is bolted to well flange 62 (FIGS. 1 and 2).

The illustrated mounting arrangement provides for optimum accelerometer alignment. Many accelerometers are by design affected in their output by placement in regard to the direction of the vibration path. Their greatest output or greatest sensitivity is when the accelerometer is placed with its axis parallel to the direction of the vibration path. The axes of the accelerometers 40 and 42 are parallel to the casing axis at the wellhead which is parallel to the direction of the path of vibrations travelling along the length of the casing. This is advantageous in that the accelerometers will inherently reject transaxial vibrations which may be caused, for example, by equipment located in the vicinity of the well head.

When mounting the vibration device 32 to the wellhead 14, preferably the support plate 44, with the accelerometers 40 and 42 thereon, is detached from the mounting lug 48 when the mounting lug is securely attached to the wellhead. This avoids the danger of damaging the accelerometers during the mounting procedure. After securely attaching the mounting lug to the wellhead flange, the support plate 44 with the accelerometers thereon can be gently but securely attached and aligned to the proper orientation by using the union nut 50.

The accelerometers 40 and 42 preferably are high quality industrial units such as Model No. 8315 accelerometers available from Bruel & Kjer of Copenhagen, Denmark. these accelerometers have a frequency range of 0.1 hz to 17,000 hz and are, by design. Class I, Div. I rated for hazardous areas. The accelerometers are connected by an appropriate interconnecting cable to a power supply and an intervening intrinsically safe barrier diagrammatically represented at 76 in FIG. 4. As known in the art, an intrinsically safe barrier is an energy-limiting device in the circuit connecting the instrument in the hazardous area and a power source/controller in the safe area.

The accelerometers 40 and 42 preferably are a matched pair providing redundancy. As shown, the accelerometers are oppositely disposed and preferably are precisely on center with repect to one another. The outputs of the two accelerometers may be compared to verify proper operation. For example, the outputs may be paired and opposed such that if the combined output of the two accelerometers provides a null reading, this verifies that each output is equal giving assurance of proper operation of the accelerometers.

Oftentimes more than one existing well will need to be monitored during drilling of a new well in close proximity. Accordingly, a vibration device 32 may be mounted as shown to the wellhead of each existing well. If the mounting devices are identically mounted such as by use of the mounting bracket 46, the vibration devices will provide equal output for identical acoustic input from well to well. To further assure repeatable output/input correlation, the accelerometers may be calibrated from time to time with an acceleration table. For improved repeatability and convenience, the calibration procedure may be carried out by using the support plate 44 as a convenient means to attach the accelerometer pair to the calibration table. That is, the support plate 44 may be detached from the mounting lug 48 and attached to the calibration table for performance of the calibration procedure. After the accelerometers have been calibrated, the support plate may be reattached to the mounting lug already installed on the wellhead.

Figure 4:
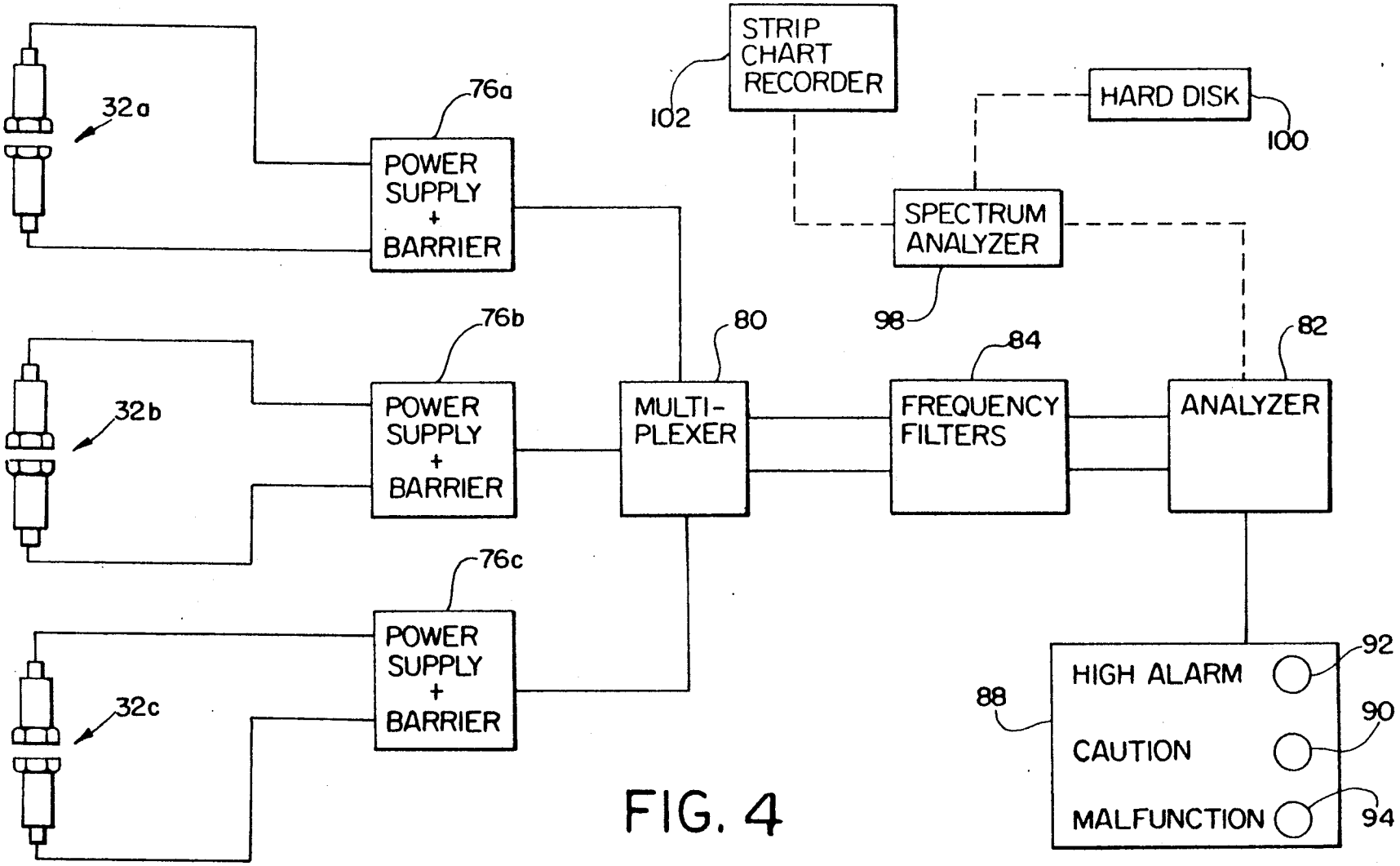
FIG. 4 is a diagrammatic illustration of a monitoring system according to the invention.

Referring now to FIG. 4, plural vibration devices mounted to respective wellheads are indicated at 32*a*–32*c*. As above indicated, multiple vibration detectors may be required to monitor multiple existing wells in the vicinity of a new well being drilled. Each detector has associated therewith a power supply and an intervening intrinsically safe barrier 76*a*–76*c*. To facilitate monitoring of the plural vibration detectors, a multi-channel multiplexer 80 may be employed to select as necessary the outputs from each pair of accelerometers for passage to an analyzer 82. The rate of sampling, duration and sequencing of each sample may be determined and adjusted as required. Signal amplification may be provided as needed.

As above indicated, the important acoustic information on drill bit location exists in comparatively narrow frequency bands consisting of one or more signature frequencies. Accordingly, filters 84 may be employed to attenuate or remove unwanted information so that only frequencies of interest are passed to the analyzer.

The analyzer 82 will monitor the drill bit signature frequencies and compare the same to a predetermined criteria indicating too close approach of the drill bit. For example, the drill bit frequencies which identify the drill bit passing through the formation may be monitored and, when the level of the monitored frequencies reaches a predetermined point, an alarm signal is issued. This signal may be transmitted to a monitor panel 88 to activate a caution light 90 warning of an approaching close intersection.

The analyzer 82 also preferably monitors for metal to metal contact in a frequency range normally lower than the frequency band of the drill bit signature. Metal to metal contact or even a very close approach is expected to cause a manyfold increase in amplitude in the lower frequency range. Upon detection of such an increase which may be tenfold or more, a high alarm signal may be issued. The high alarm signal may be used to activate a high alarm light 92 on the monitor panel 80.

The analyzer 82 may also interrogate each vibration detector to verify proper operation. Should an anomaly appear, e.g., a non-null combined output of the opposed and paired accelerometers, the analyzer can generate a third alarm signal announcing a malfunction in the system. The third signal may be used to activate a corresponding light 94 on the monitor panel. The analyzer interrogation can detect among other faults cut or damaged cables, or intermittent connections thereby avoiding common problems that may occur in the oil field workplace.

Preferably, the outputs of the paired accelerometers are simultaneously multiplexed to the analyzer and a frequency response function is automatically computed each time the pair is scanned. Conventional two channel frequency spectrum analyzers are known to have provision for computing the frequency response function. Preferably, the frequency in the frequency range of interest having the greatest amplitude is selected for performance of the comparison. Accordingly, the frequency response function is essentially the ratio of one Fourier transform to the other at a specific frequency, and this ratio can be used to identify if there is a problem with one of the accelerometers, such as when the ratio deviates more than a predetermined amount from unity. In this set-up, a ratio of 1.0 indicates matched performance and no malfunction. The frequency at which the comparison is made preferably is selected automatically for each reading. An appropriately programmed computer may be used to perform these procedures automatically.

The monitor panel 88 may be appropriately located as at the drilling control station for the new well being drilled. In addition to providing a visual alarm, corresponding audible alarms may be sounded. Drilling rig personnel seeing and/or hearing an alarm may then take appropriate action. In the case of a caution signal, the drilling rig personnel may initiate redirection of the drilling bit away from the existing well or wells. In the case of a high alarm, the drilling rig personnel normally would immediately cease drilling to avoid perforation of the existing casing being contacted by the drill bit. If desired, the high alarm signal, or even the warning signal, may be employed to effect automatic shutdown of the drilling equipment.

A spectrum analyzer 98 may be employed in the illustrated monitoring system to permit visual observation of acoustic frequency information by trained technicians as during drilling periods when close passage of the drilling bit by existing wells is anticipated. In response to observed vibration data the technician may issue an alarm warning of a close approach or actual contact of the drill bit with the well being monitored. If desired, output data of the spectrum analyzer and/or analyzer 82 may be stored for later analysis by suitable means such as in a hard disk 100 coupled to or included in an appropriately programmed computer. As will be evident to those skilled in the art, appropriately programmed computer equipment may be employed to perform the comparative analysis of the frequency data to determine when an alarm signal is to be generated and further to control analyzer interrogation. The computer equipment may also be used for overall detector system control, as would usually be the case.

Although it is preferably to configure the system for automatic generation of alarm signals, reliance may be had on generation of alarm signals by a technician monitoring the vibrations transmitted to the surface via the casing of the well being monitored. As above indicated, the vibrations may be visually monitored using, for example, a spectrum analyzer. Alternatively or additionally, earphones, and more particularly electrostatic headphones, may be used to provide real-time monitoring of the drilling activity as well as verifying proper functioning of the transducers to which the earphones are connected via suitable electronic equipment. The earphones should be of a high quality for maximizing reproduction at low frequencies as the frequency spectrum of principal interest is from 8 to 400 Hz. In those instances where the headphones are used in a noisy environment, the headphones should provide very tight ear-transducer coupling to minimize external sounds.

Equipping the driller with such earphones during periods of close intersection drilling would provide the driller with meaningful information. Increases or decreases in drill rotation speed would be instantly discernible to the driller as would increases or reductions in drill stem weight as verified by corresponding changes in sound intensity as transmitted to the headphones. A simple system for providing protection against accidental intersection may consist of a single accelerometer, amplifier and headphones coupled with an experienced driller.

a multichannel strip chart recorder 102 may be employed to provide a real time print out of the totalized acoustic energy in multiple channels for immediate and/or future reference. The charts could also note low and high level alarms as transmitted to the driller, identifying the time of the alarms, the real depth of the drill bit at the time of the alarm, and the channel of interest. Preferably the recorder is automatically controlled by a computer.

As various methods and equipment are employed for drilling wells, the acoustic signatures may vary accordingly. The acoustic signatures can be analyzed by a spectrum analyzer to identify the appropriate frequency band or bands to be monitored by the analyzer. Present belief is that useful frequency signatures of conventional drill bits and associated drilling methods will fall in the range of 0.1 hz to 10,000 hz and more particularly in the range of 0.5 hz to 1,000 hz with the most significant region being 100 hz to 500 hz. For drill bit contact with an existing casing, useful frequencies are believed to exist in the range of 1 hz to 50 hz and more particularly in the range of 5 hz to 20 hz.

In a more general sense the present invention provides a method and apparatus for noninvasive surface monitoring of mechanical operations downhole. For example, the system may be employed to monitor performance of a mud motor by extracting useful information from vibrations traveling from the mud motor to the surface via the well casing. The system may be used to assist in production and drilling operations such as fishing, well cleanouts and other downhole mechanical operations inside a cased well. Vibrations transmitted to the surface through the casing may be deciphered to extract the information of interest therefrom.

From the foregoing it can be seen that the present invention provides a method and apparatus that does not require use of a sensor, logging tool or other device that is lowered into a well. Instead, the invention provides for sensing of vibrations in the casing of a well which casing serves to transmit downhole noise (vibrations) to the vibrations sensor or sensors preferably located at the surface. What has been found is that useful information can be extracted from vibrations traveling to the surface via an existing well casing.

Although the invention has been descried in relation to the extraction of useful information from downhole vibrations transmitted to the surface or a remote location via a well casing, downhole vibrations may be transmitted to the surface via a production string or other metal tubing string disposed in the well. Typically, the production string will be coupled to the well head along with the casing, in which case vibration devices mounted to the well head would detect vibrations transmitted along both the production string and casing.

What is claimed is:

1. A method for preventing the drilling of a new well into a nearby existing well in a subterranean formation, comprising the steps of:

a) detecting vibrations in the existing well during drilling of the new well, and b) monitoring the detected vibrations and issuing an alarm signal when the detected vibrations satisfy a predetermined criteria indicating too close approach of the new well to the existing well, and wherein said detecting step includes using a least one vibration detecter coupled to a metal tubing string at a first location in the existing well to detect vibrations in the existing well transmitted through the tubing string from a second location remote from said first location.

2. A method as set forth in claim 1, wherein the alarm signal actuates a signal light or audible signal.

3. A method as set forth in claim 1, wherein the tubing string includes a metal casing in the existing well and the vibration detector is coupled to the metal casing.

4. A method as set forth in claim 3, wherein the vibration detector is coupled to the metal casing at or near the surface of the formation.

5. A method for preventing the drilling of a new well into a nearby existing well in a subterranean formation, comprising the steps of:

(a) detecting vibrations in the existing well during drilling of the new well, and (b) monitoring the detected vibrations and issuing an alarm signal when the detected vibration satisfy a predetermined criteria indicating too close approach of the new well to the existing well, and wherein said detecting step includes using at least one vibration detector coupled to a metal tubing string in the existing well to detect vibrations in the existing well, and the vibration detector includes at least one accelerometer.

6. A method as set forth in claim 5, wherein said at least one accelerometer includes a pair of accelerometers that are coupled to the metal tubing string, and including the step of using the outputs of the two accelerometers to verify proper operation of the accelerometers.

7. A method for preventing the drilling of a new well into a nearby existing well in a subterranean formation, comprising the steps of:

(a) detecting vibrations in the existing well during drilling of the new well, and (b) monitoring the detected vibrations and issuing an alarm signal when the detected vibrations satisfy a predetermined criteria indicating too close approach of the new well to the existing well, and wherein said detecting step includes using at least one vibration detector coupled to a metal tubing string in the existing well to detect vibrations in the existing well, and said monitoring step includes monitoring at least one selected band of frequencies corresponding to the acoustic signature of a drill bit drilling the new well.

8. A method as set forth in claim 7, wherein said selected band of frequencies is within the range of 0.1 hz to 10,000 hz.

9. A method as set forth in claim 9, wherein said selected band of frequencies is within the range of 0.1 hz to 500 hz.

10. A method as set forth in claim 7, wherein the alarm signal is issued when the amplitude of the selected frequency band exceeds a predetermined level.

11. A method for preventing the drilling of a new well into a nearby existing well in a subterranean formation, comprisng the steps of:

(a) detecting vibrations in the existing well during drilling of the new well, and (b) monitoring the detected vibrations and issuing an alarm signal when the detected vibrations satisfy a predetermined criteria indicating too close approach of the new well to the existing well, and wherein said detecting step includes using at least one vibration detector coupled to a metal tubing string in the existing well to detect vibrations in the existing well, and said issuing step includes issuing a low alarm corresponding to a closely approaching drill bit and a high alarm corresponding to contact or near contact of a drill bit with a metal tubing string in the existing well.

12. Apparatus for preventing the drilling of a new well into a nearby existing well in a subterranean formation, comprisng detecting means for detecting vibrations in the existing well during drilling of the new well, and monitoring means for monitoring the detected vibrations and issuing an alarm signal when the detected vibrations satisfy a predetermined criteria indicating too close approach of the new well to the existing well, said detecting means including at least one vibration transducer and means for coupling the vibration transducer to a metal tubing string in the existing well for detecting vibrations in the existing well.

13. Apparatus as set forth in claim 12, wherein the alarm signal actuates a signal light or audible signal.

14. Apparatus as set forth in claim 12, wherein the tubing string includes a casing in the existing well and said vibration transducer is coupled to said casing.

15. Apparatus for preventing the drilling of a new well into a nearby existing well in a subterranean formation, comprising detecting means for detecting vibrations in the existing well during drilling of the new well, and monitoring means for monitoring the detected vibrations and issuing an alarm signal when the detected vibrations satisfy a predetermined criteria indicating too close approach of the new well to the existing well, said detecting means including at least one vibration transducer and means for coupling the vibration transducer to a metal tubing string in the existing well for detecting vibrations in the existing well, and the vibration transducer including at least one accelerometer.

16. Apparatus as set forth in claim 15, wherein said at least one accelerometer includes a pair of accelerometers coupled to the metal tubing string, and means for comparing the outputs of the two accelerometers to veryify proper operation of the accelerometers.

17. Apparatus for preventing the drilling of a new well into a nearby existing well in a subterranean formation, comprising detecting means for detecting vibrations in the existing well during drilling of the new well, and monitoring means for monitoring the detected vibrations and issuing an alarm signal when the detected vibrations satisfy a predetermined criteria indicating too close approach of the new well to the existing well, said detecting means including at least one vibration transducer and means for coupling the vibration transducer to a metal tubing string in the existing well for detecting vibrations in the existing well, and said monitoring means including means for monitoring at least one selected band of frequencies corresponding to the acoustic signature of a drill bit drilling the new well.

18. Apparatus as set forth in claim 17, wherein said selected band of frequencies is within the range of 0.1 hz to 10,000 hz.

19. Apparatus as set forth in claim 17, wherein the alarm signal is issued when the amplitude of the selected frequency band exceeds a predetermined level.

20. Apparatus for preventing the drilling of a new well into a nearby existing well in a subterranean formation, comprising detecting means for detecting vibrations in the existing well during drilling of the new well, and monitoring means for monitoring the detected vibrations and issuing an alarm signal when the detected vibrations satisfy a predetermined criteria indicating too close approach of the new well to the existing well, said detecting means including at least one vibration transducer and means for coupling the vibration transducer to a metal tubing string in the existing well for detecting vibrations in the existing well, and said monitoring means includes means for issuing a low alarm corresponding to a closely approaching drill bit and a high alarm corresponding to contact or near contact of a drill bit with a metal tubing string in the existing well.

21. Apparatus for preventing the drilling of a new well into a nearby existing well in a subterranean formation, comprising detecting means for detecting vibrations in the existing well during drilling of the new well, and monitoring means for monitoring the detected vibrations and issuing an alarm signal when the detected vibrations satisfy a predetermined criteria indicating too close approach of the new well to the existing well, said detecting means including at least one vibration transducer and means for coupling the vibration transducer to a metal tubing string in the existing well for detecting vibrations in the existing well, and the vibration tranducer is coupled to the metal tubing string at or near the surface of the formation.

22. A method of preventing the drilling of a new well into a nearby existing well in a subterranean formation, comprising the steps of:

a) detecting vibrations in the existing well that are caused by drilling of the new well, and b) monitoring the detected vibrations and issuing an alarm signal when the detected vibrations satisfy a predetermined criteria indicating too close approach of the new well to the existing well.

23. A method as set forth in claim 22, wherein said detecting step includes using a vibration detector coupled to a casing in the existing well to detect vibrations induced in the casing by drilling of the new well.

24. A method of preventing the drilling of a new well into a nearby existing well in a subterranean formation, comprising the steps of:

(a) detecting vibrations in the existing well that are caused by drilling of the new well, and (b) monitoring the detected vibrations and issuing an alarm signal when the detected vibrations satisfy a predetermined criteria indicating too close approach of the new well to the existing well, and wherein the vibration detector is coupled to a casing in the existing well at or near the surface of the formation to detect vibrations induced in the casing by drilling of the new well.

25. A method of preventing the drilling of a new well into a nearby existing well in a subterranean formation, comprising the steps of:

(a) detecting vibrations in the existing well that are caused by drilling of the new well, and (b) monitoring the detected vibrations and issuing an alarm signal when the detected vibrations satisfy a predetermined criteria indicating too close approach of the new well to the existing well, and wherein said monitoring step includes monitoring at least one selected band of frequencies and the alarm signal is issued when the amplitude of the at least one selected band of frequencies exceeds a predetermined level.

26. A method of remotely monitoring activity downhole in a borehole in a subterranean formation, the borehole containing a stationary metal tubing string, comprising the steps of:

(a) using a vibration detector coupled to the stationary tubing string in the borehole to detect unmodulated vibrations that are induced in the tubing string by the activity being monitored and transmitted through the tubing string, and (b) monitoring the output of the vibration detector to obtain information about the activity occurring downhole in the borehole.

27. A method as set forth in claim 26, wherein the vibration detector is coupled to the tubing string at or near the surface of the formation for detecting vibrations transmitted to the surface via the tubing string.

* * * * *